United States Patent [19]

Berryman

[11] Patent Number: 4,460,041

[45] Date of Patent: Jul. 17, 1984

[54] SUBTERRANEAN WELL TOOL WITH PRESSURE EQUALIZING RELEASE

[75] Inventor: William O. Berryman, Houston, Tex.

[73] Assignee: Baker Oil Tools, Inc., Orange, Calif.

[21] Appl. No.: 417,012

[22] Filed: Sep. 13, 1982

[51] Int. Cl.[3] ..... E21B 33/12

[52] U.S. Cl. ..... 166/134; 166/128; 166/131

[58] Field of Search ..... 166/134, 131, 126–128, 166/147, 149, 150, 152, 382, 386, 387, 332, 334, 133, 188

[56] References Cited

U.S. PATENT DOCUMENTS

| | | | |
|---|---|---|---|
| 3,266,576 | 8/1966 | Chenoweth | 166/131 |
| 3,306,366 | 2/1967 | Muse | 166/128 |
| 3,433,301 | 3/1969 | McEver, Jr. | 166/128 |
| 3,434,538 | 3/1969 | Kilgore et al. | 166/134 |
| 3,526,277 | 9/1970 | Scott | 166/127 |
| 3,570,595 | 3/1971 | Berrtman | 166/128 |
| 4,345,649 | 8/1982 | Baugh et al. | 166/387 X |

*Primary Examiner*—Ernest R. Purser
*Assistant Examiner*—Thuy M. Bui
*Attorney, Agent, or Firm*—Norvell & Associates

[57] ABSTRACT

A retrievable well tool for use in a subterranean well utilizes plural valving elements to establish a fluid by-pass around an annular elastomeric sealing element in response to either downward or upward movement of a control mandrel. The fluid by-pass established by movement of the control mandrel is accomplished prior to any effective disengaging movement being imparted to the cooperating cone and slip elements.

14 Claims, 8 Drawing Figures

SUBTERRANEAN WELL TOOL WITH PRESSURE EQUALIZING RELEASE

BACKGROUND OF THE INVENTION

1. Field of the Invention

This invention relates to a subterranean well tool, such as a bridge plug for temporary installation in an oil well conduit, of the type having an elastomeric seal element producing relative movement between cooperating cone and slip elements to sealingly lock the bridge plug in the conduit, wherein pressure equalization across the elastomeric seal element is effected prior to releasing the slip elements from engagement with the conduit.

2. Description of the Prior Art

Bridge plugs have been employed in subterranean wells for many years. The primary purpose of a bridge plug is to provide a temporary anchoring of a tool at a desired location in a well conduit, accompanied by a sealing of the annular space between the tool and the internal wall of the well conduit. Bridge plugs in commercial use, such as the Model C Retrievable Bridge Plug sold by BAKER SERVICE TOOLS of Houston, Tex., typically utilize a hollow tubular body on which two axially spaced sets of cone elements are secured. Intermediate the cone elements, a pair of axially spaced sets of slip elements are mounted on a cross link which is supported in diametrically opposed slots in the tubular body so that relative movement of the tubular body with respect to the slip elements in either direction will produce an outward camming of one set of slips into engagement with the conduit wall, but not the other set of slips. Such relative movement is produced by one of a pair of annular elastomeric sealing elements, commonly referred to as packer cups, which are respectively mounted on the tubular body adjacent the cone elements. One packer cup is responsive to a downward fluid pressure differential to move the tubular body downward, while the other is responsive to an upward fluid pressure differential to move the tubular body upwardly. Thus, when such conventional bridge plug is positioned at a desired location in the well conduit, the existence of an upwardly or downwardly directed fluid pressure differential across the packer cups will determine whether the lowermost cone moves upwardly to engage the adjacent set of slips or the uppermost set of cones moves downwardly to engage the adjacent set of slips. In either event, only one set of slips is cammed outwardly into engagement with the conduit wall in response to the existing fluid pressure differential.

The tubular body is carried into the well by a mandrel inserted therethrough which is provided with appropriate slots to accommodate the cross link. A running in tool engages the upper end of the mandrel and the upper end of the tubular body to maintain these elements in a desired axial relationship during the running in of the tools. An annular fluid passage is defined between the exterior of the mandrel and the interior of the tubular body and such passages are closed at each end by a spring pressed annular piston valve. A downwardly facing abutment shoulder on the mandrel is engageable with the lowermost piston valve to shift such valve to an open position by downward movement of the mandrel as the first step in releasing the bridge plug from the conduit. The opening of the lower piston valve produces an equalization of pressure across the lowermost elastomeric sealing element so that the slip element associated with the lowermost cone may be moved upwardly off the cone surface by upward movement of the tubular body member. Such upward movement of the tubular body member is produced by an upwardly facing shoulder provided on the mandrel which engages the uppermost piston valve and moves it to an open position and then into abutting relationship with the downwardly facing shoulder on the tubular body to initiate the upward movement of the tubular body. Thus, with both piston valves having been opened, it was presumed that pressure balancing across the two elastomeric seal elements would be achieved.

In the practical utilization of this type of valve, some difficulties have been encountered. For example, the initial downward movement of the mandrel required to open the lower piston valve to achieve equalization of pressure across the lower elastomeric sealing element is often accomplished by the operator very rapidly so that the pressure differential across the lower elastomeric sealing element is not completely neutralized. As the mandrel is moved upwardly, any residual pressure differential or pressured well fluids will cause the lower cone to remain in engagement with the lower set of slips and effect the anchoring of the tubular body to the conduit wall, thereby preventing withdrawal of the tool without incurring serious damage to the conduit wall and/or the slips. Also, as the tool is raised upwardly through the well conduit it may pass through production zones where well fluids are flowing into the conduit, thus providing a fluid pressure differential across the lower elastomeric sealing element with the same adverse results as heretofore mentioned.

In an effort to overcome these difficulties, another type of bridge plug has been developed which included not only the piston type valve at the top end of the tool and a sleeve valve in place of the lowermost piston valve which, after the mandrel is elevated to release the lowermost slips from the lowermost cones, will open and remain open to maintain a fluid pressure equalization passage around the lowermost elastomeric seal element. This construction may be inadequate to prevent damage to the tool during retrieval when pressure equalization around the lowermost elastomeric sealing element is not achieved prior to movement of the slip elements by the mandrel.

There is, therefore, a recognized deficiency in the prior art bridge plug constructions in that pressure equalization across the lowermost annular sealing element is not assured prior to initiation of the release of the slips from the lowermost cones.

SUMMARY OF THE INVENTION

This invention provides a modified bridge plug construction wherein a third valve is provided in a fluid by-pass around the lowermost annular elastomeric sealing element. Such valve is actuated to an open position by any upward movement of the mandrel, thus achieving fluid pressure equalization across the lowermost annular elastomeric sealing element prior to initiating movement of the the slip and cone elements from their engaged position. This desirable feature is accomplished by incorporation of means, such as a lost motion connection between the mandrel and the tubular body element and between the mandrel and the slips, which requires movement of the mandrel relative to the tubular body element and relative to the slips in excess of that required to open the third valve. It is thereby assured that the fluid by-pass is established across the lowermost annular elastomeric seal element for pressure equalization purposes prior to initiation of any movement of the tubular body and slips.

Other advantages of the invention will be readily apparent to those skilled in the art from the following detailed description, taken in conjunction with the annexed sheets of drawings, on which is shown a preferred embodiment of the invention.

BRIEF DESCRIPTION OF THE DRAWINGS

FIGS. 1B, 1C, 1D and 1E being respectively vertical continuations of FIGS. 1A, 1B, 1C and 1D.

DESCRIPTION OF PREFERRED EMBODIMENTS

Figure 1A:
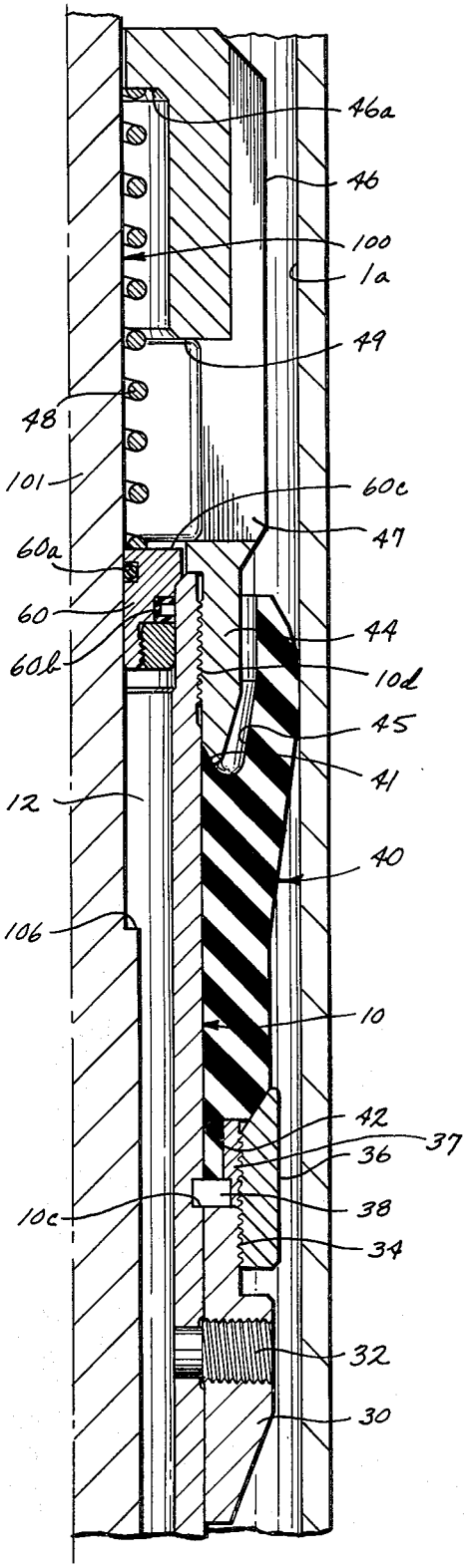
FIGS. 1A, 1B, 1C, 1D and 1E collectively represent a vertical quarter sectional view of a bridge plug incorporating a pressure equalizing feature embodying this invention.

Referring to the drawings, a well tool, such as a bridge plug, involving the pressure equalizing feature of this invention, is shown as comprising a tubular body assembly 10 on which are mounted in conventional fashion expandable upper and lower slip elements 20 and 20', which are respectively expanded into engagement with the inner wall 1*a* of the well conduit 1 by axially spaced cone elements 30 and 30'. Above the upper cone element 30 a conventional packer cup 40, comprising an annular elastomeric sealing element that is unidirectionally responsive to downward fluid pressure is secured to the tubular body 10, and below the lower cone elements 30' a similar packer cup 40' which is unidirectionally responsive to upwardly directed pressure differential is secured to the tubular body 10. Lastly, a conventional drag spring 50 is secured to the lower portions of tubular body assembly 10 and terminates in an annular drag ring head 52 which freely surrounds the lower end 103 of a control bar or mandrel 100.

The control bar or mandrel 100 is a rod-like element having an upper rod portion 101, an intermediate sleeve portion 102 and a lower rod portion 103. A control bar head 104 is secured to its upper end and provides a radially projecting pin 95 for cooperation with a conventional J-slot actuating sleeve (not shown). Mandrel 100 is normally retained in an inoperative position with respect to the tubular body 10 by a pair of opposed compression springs 70 and 70' which are respectively mounted between downwardly and upwardly facing surfaces projecting into the annulus 12 defined between the tubular body 10 and control mandrel 100 in a manner to be hereinafter described and at their other ends, respectively urge a pair of valving pistons 80 and 80' against the upwardly and downwardly facing end surfaces 105*a* and 105*b* of an external shoulder 105 formed on the medial portions of the mandrel sleeve 102.

Referring now specifically to FIGS. 1A–1E, the slip units 20 and 20' constitute conventional rocker type units employed in the Baker Model C Retrievable Bridge Plug sold by BAKER SERVICE TOOLS of Houston, Tex. Such slip elements will not, therefore, be described in detail but it should be noted that the conduit engaging teeth 21 of the upper slip unit 20 are shaped so as to prevent downward movement of that slip element relative to the conduit while the teeth 21' of the lower slip unit 20' are shaped to prevent upward movement of that slip element when engaged with the conduit wall 1*a*. Both sets of slip elements 20 and 20' are mounted on the radially outer ends of a cross link 22 which in turn is disposed within an elongated slot 11 formed in the tubular body 10 and a slot 101*a* formed in the upper rod portion 101 of mandrel 100. Slip units 20 and 20' are therefore free to move axially relative to both the tubular body 10 and the mandrel 100 thru a limited distance.

Slips 20 and 20' are normally held in a retracted position through the action of compression springs 27 and 27' which rock the non-serrated ends of the slip elements 20 and 20' around retaining bands 24 and 24'. The non-serrated ends of slip elements 20 and 20' are respectively provided with frictional inserts 23 and 23' to frictionally engage the conduit wall 1*a* as the tool is inserted in the well conduit 1. A ring element 26 has its opposite axial ends 26*a* and 26*b* respectively cooperable with the adjacent ends of slip elements 20 and 20' and receives set screws 29 and 29'.

The actuating cones 30 and 30' of the slip elements 20 and 20', respectively constitute conventional cone shaped annular members which are rigidly secured to the periphery of the tubular body 10 by set screws 32 and 32'. The upper end of the cone 30 is provided with external threads 34 on which a packing cup retaining ring 36 is threadably engaged. A split ring 38 underlies the packing cup retaining ring 36 and cooperates with an annular groove 10*c* provided in the external wall of the tubular body 10 to further anchor cone 30. A ring 37 underlies ring 36 and is bonded to the packing cup.

The annular elastomeric packing cup 40 is of conventional configuration and has a reduced diameter end 42 bonded to the retaining ring 37. At the other end of the packing cup 40, an internal recess 45 is defined within which a second packing cup retaining ring portion 44 fits and overlies an upwardly projecting portion 41 of packing cup 40. The second packing cup retaining ring portion 44 is threadably secured to external threads 10*d* provided on the upper end of the tubular body 10.

The second packing cup retaining ring portion 44 constitutes an integral lower portion of an upper valve cage element 46 which terminates at its upper end with an internally projecting flange 46*a*, providing a mounting for the upper end of a compressible valve spring 48. The other end of spring 48 seats against the upper surface of an annular piston type valve 60, hereinafter called the top bypass valve, which normally seals the annulus 12 defined between the interior of the tubular body 10 and the exterior of the mandrel 100. The seal elements 60*a* and 60*b* on the valve 60 respectively cooperate with the external surface of upper rod portion 101 of mandrel 100 and the internal surface of tubular body 10. One or more fluid passages 47 are provided in valve cage 46.

In addition to performing the valving function, the valve 60 acts as part of a lost motion connection between the mandrel 100 and the tubular body 10. An external shoulder 106 is formed on the rod portion 101 of mandrel 100 and normally positioned some distance below the lower face of the annular piston valve 60. As the mandrel 100 is raised with respect to the tubular body 10, the shoulder 106 engages the bottom face of the piston valve 60 and moves such valve upwardly, compressing spring 48, until the top face 60*c* the piston valve 60 engages a downwardly facing surface 49 defined on the valve cage 46. Further upward movement of mandrel 100 will then produce a corresponding upward movement of the tubular body 10.

The lower cone element 30' is identical in construction to the previously described upper cone element 30 and is secured to the exterior of the tubular body 10 by set screws 32'. The lower end of the lower cone unit 30' is provided with a threaded section 34' to which is secured a first packing cup retaining ring 36', which overlies the upper end 42' of the lower packing cup 40' and a retaining ring 37' in the same manner as heretofore described in connection with the upper packing cup 40. A C-ring 38' further anchors the assembly to the tubular body 10. The lower projecting portion 41' of the lower packing cup 40' is secured in position by an overlying end portion of a body extension sleeve 14 which is threadably engaged to external threads 10*e* provided on the lower end of the tubular body 10.

The sleeve 14 constitutes, in effect, an extension of the tubular body 10 and defines at its bottom end a conventional anchor portion 15 for the upper end of the drag spring 50. A drag ring 19 surrounds anchor portion 15 and is retained in position by set screw 19*a*.

Anchor portion 15 defines internal threads 15*a* which receive a threaded upper end of a lower body extension sleeve 16. Extension sleeve 16 is provided with internal threads 16*a* at its bottom end, and an annular cap 18 is secured to threads 16*a*. The upper end of the lower extension sleeve 16 is provided with an internally projecting flange 16*b* respectively defining an upwardly facing annular surface 16*c* and a downwardly facing annular surface 16*d*. A seal 17 is provided between the upper end of flange 16*b* and the lower end of extension sleeve 14.

In the normal or inoperative position of the mandrel 100 relative to the tubular body 10, the external shoulder 105 on the sleeve portion 102 of mandrel 100 is disposed in juxtaposition to the internally projecting flange 16*b*. Two annular valve chambers 82 and 82' are thus defined on the opposite ends of the juxtaposed flanges 105 and 16*b*. The previously mentioned annular valving pistons 80 and 80' are respectively mounted in the annular chambers 82 and 82' and are respectively provided with seal elements 83 and 84, 83' and 84' to achieve a sealing relationship with the walls of the annular chambers 82 and 82'.

As previously mentioned, the compression springs 70 and 70' are normally respectively acting on the ends of the valving pistons 80 and 80' and thus urge the mandrel 100 into an inoperative position relative to the tubular body 10. The upper end of spring 70 is engaged by an annular abutment sleeve 90. Abutment sleeve 90 is provided with an external flange 92 which projects into an annular recess 14*c* defined between the lower end of the tubular body 10 and the extension sleeve 14. O-ring seals 96 and 94 are respectively mounted on the abutment sleeve 90 to effect a sealing engagement with the internal wall of the tubular body 10 and the external wall of the intermediate sleeve portion 102 of the mandrel 100. The lower end of spring 70' abuts the end face 18*a* of cap 18.

Obviously, if the mandrel 100 is moved upwardly or downwardly relative to the tubular body 10, the piston valve 80 or 80' will be axially displaced depending upon whether the movement is in an upward or a downward direction. In accordance with this invention, the selective displacement of the annular piston valves 80 and 80' is utilized to insure that complete pressure equalization occurs across the lower annular elastomeric packing cup 40' prior to initiation of any upward movement of the tubular body 10, or the cross-link 22 and slip elements 20 and 20'.

Figure 1B:
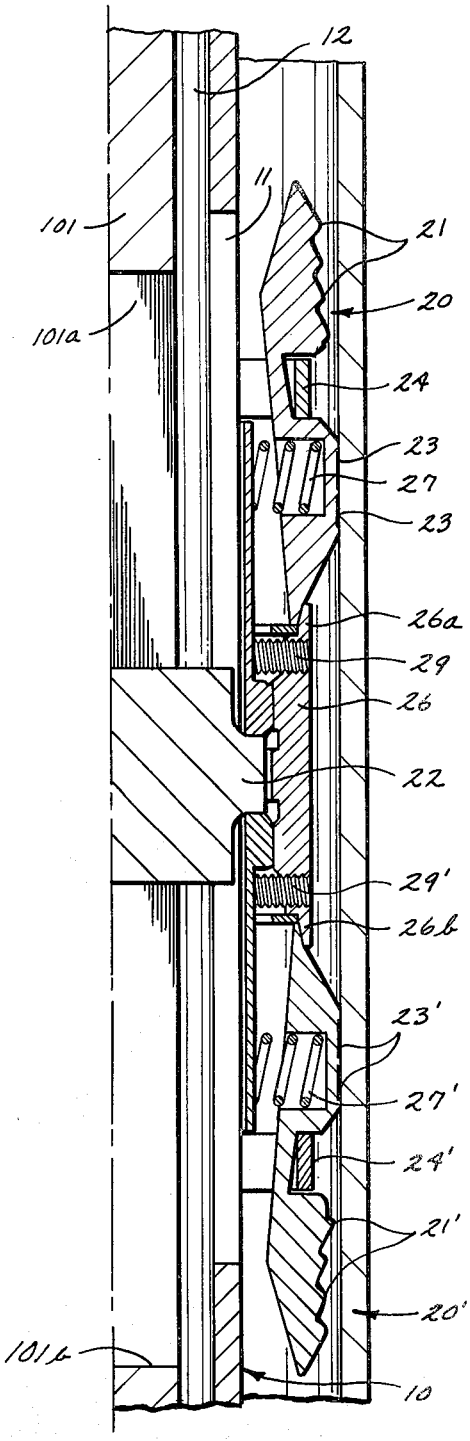
Figure 1C:
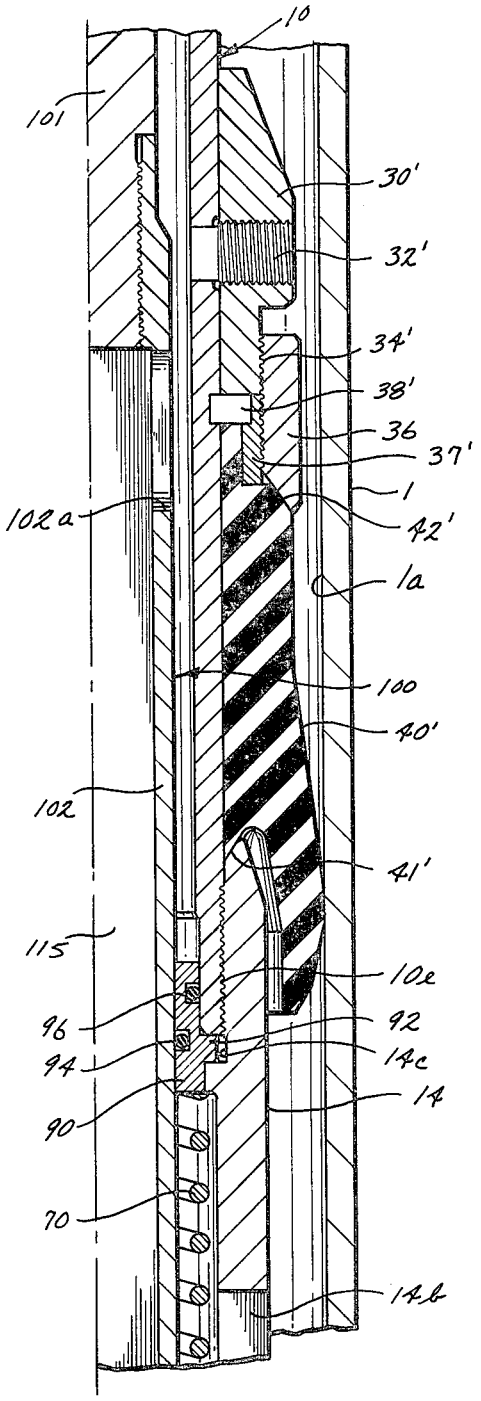
Figure 1D:
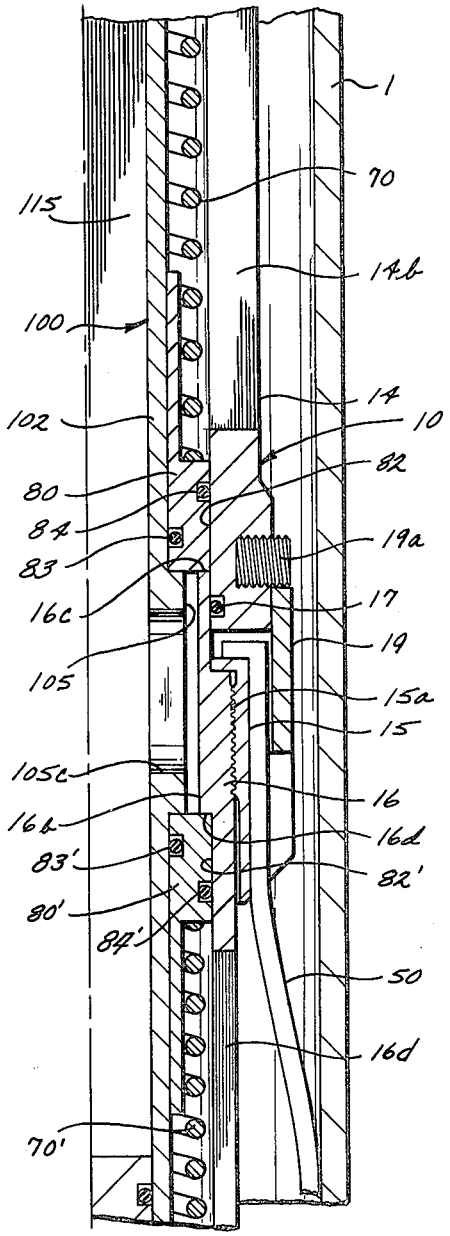
Figure 1E:
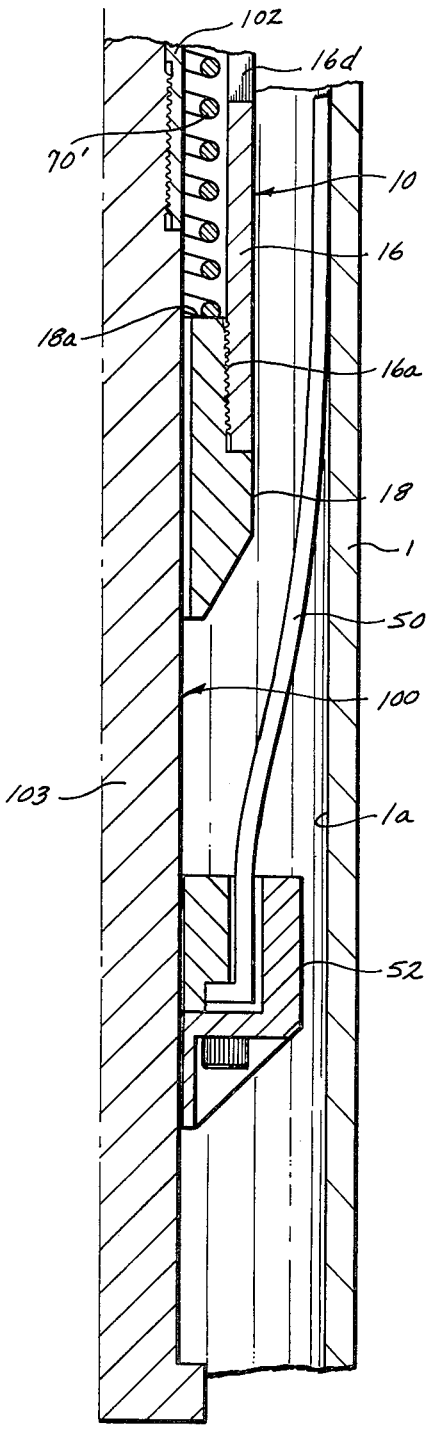

A fluid by-pass passage 115 is provided by the hollow central portion of the intermediate sleeve portion 102 of the mandrel 100. At the upper end of such sleeve portion, one or more radial slots 102*a* (FIG. 1C) are provided, thus assuring free fluid flow from that portion of the conduit bore lying above the seal effected by the lower packer cup 40'. The central fluid passage 115 through the mandrel is further connected at its lower end to one or more radial ports 105*c* (FIG. 1D) provided in the mandrel flange 105. So long as the annular piston valves 80 and 80' are in their positions corresponding to the mandrel 100 being in its inoperative position, as shown in FIG. 1B, such valving pistons prevent fluid flow from bypass passage 115 into or out of the annular valving chambers 82 and 82'.

One or more axially extending slots 14*b* are provided in the wall of the body extension sleeve 14 to supply fluid from the portion of the conduit bore located below the packer cup 40' to the by-pass passage 115 within the mandrel sleeve portion 102 whenever the upper piston valve 80 is moved by the mandrel to a position where it moves out of the valve chamber 82. Likewise, one or more axially extending slots 16*d* are provided in the lower body extension sleeve 16 to provide fluid flow from the region of the conduit bore below the lower packer cup 40' whenever the mandrel 10 is shifted downwardly from its inoperative position to move the annular valve piston 80' out of the valve chamber 82'.

Any significant movement of the mandrel 100 from its inoperative position relative to the tubular body 10 will result in the establishment of a by-pass fluid passage from the conduit bore region below the lower packer cup 40' to a conduit bore region above the packer cup. It is particularly important to note that the amount of upward movement of the mandrel 100 required to shift the upper annular piston valve 80 out of valve chamber 82 to establish the fluid by-pass, is significantly less than the amount of lost motion movement of the mandrel 100 in an upward direction to effect contact with the cross-link 22 or the tubular body 10 to initiate upward movement of such cross-link or body, and, hence, separation of whatever cone and slip that were previously engaged.

Those skilled in the art will understand that the described upward and/or downward movements of the mandrel 100 are readily imparted thereto by engaging the pin 95 on mandrel control head 104 (FIG. 2) with a conventional J-slot running tool (not shown), so that the mandrel 100 may be readily moved from its inoperative position relative to the tubular body 10 through the application of an upward or downward force to the mandrel control head 104.

Insofar as the operator is concerned, the installation and removal of the bridge plug is accomplished in the same fashion as prior art bridge plugs. The bridge plug embodying this invention is lowered to the desired position in the wall by a conventional wire line or tubing carried J-slot running tool (not shown) which operatively engages the J-pin 95 provided on the control bar head 104 secured to the top of the mandrel 100. When the tool is positioned at the desired location, the J-slot running head is removed from engagement with the control bar head 104 by successive reciprocations. The bridge plug automatically sets in response to either an upward or downward fluid pressure differential existing across the elastomeric packing cups.

Figure 2:
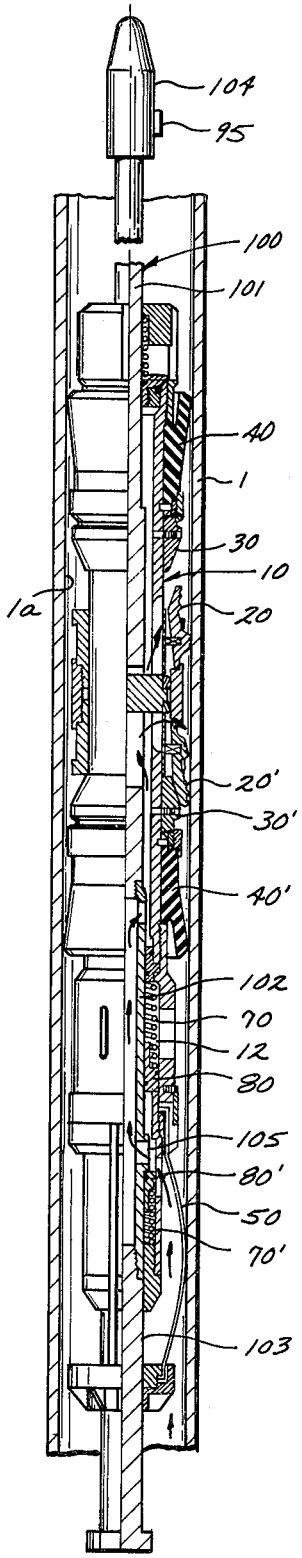
FIG. 2 is a reduced scale quarter sectional view of the bridge plug shown in FIGS. 1A–1E but illustrating the position of the elements when the mandrel is moved downwardly to initiate releasing movement of the tool.
Figure 3:
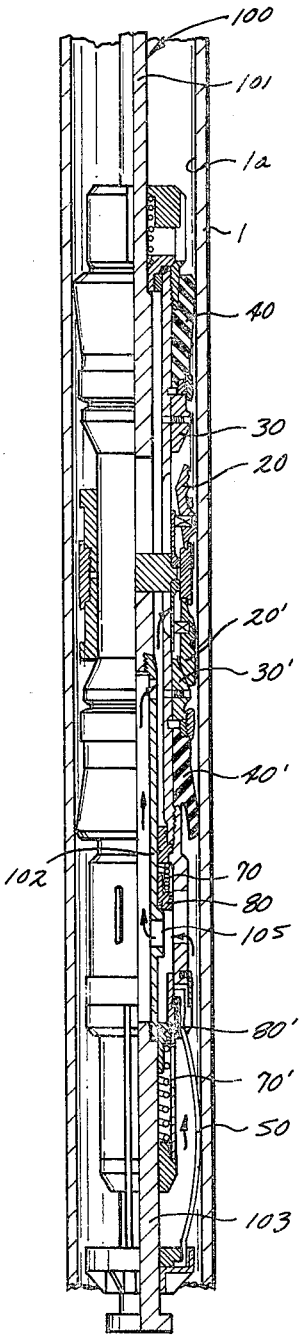
FIG. 3 is a view similar to FIG. 2 but illustrating the position of the elements during the beginning of the upward movement of the mandrel to effect the pressure equalization around the lowermost annular elastomeric sealing element.
Figure 4:
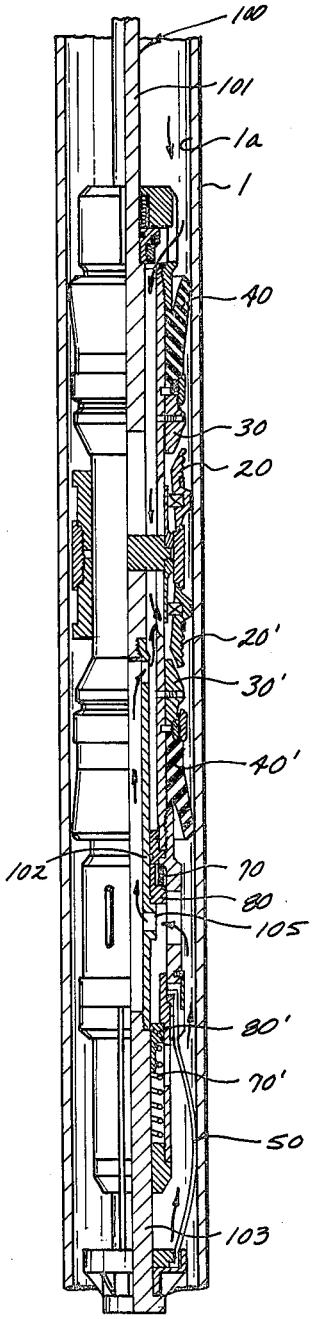
FIG. 4 is a view similar to FIG. 3 but illustrating the position of the elements when the mandrel has moved through its lost motion stroke with respect to the tubular body and is exerting an upward force on the tubular body to withdraw the tool from the well.

When it is desired to move the bridge plug, the operator re-engages the control bar head 104 and first exerts a downward force on the mandrel 100, thus shifting the lower by-pass valve unit 80' out of the cooperating valving chamber 82' and effecting equalization of pressure across the lowermost packer cup 40', if that cup unit is in fact under a differential pressure (FIG. 2). Subsequent upward movement of the mandrel 100 by the J-slot control head 104 will return the lower valving piston 80' to its fully seated position in valve chamber 82' but will concurrently initiate the movement of the upper valving piston 80 out of the annular valving chamber 82, thus re-establishing a by-pass fluid passage around the lower packer cup unit 40' and preventing a differential fluid pressure building up across such unit (FIG. 3). Upward movement of the mandrel 100 then effects the opening of the uppermost by-pass valve unit 60 and subsequently the engagement of the mandrel 100 with the tubular body 10 through the using up of all of the lost motion involved in the lost motion connection (FIG. 4). In other words, the upper surface 60*c* of the upper by-pass valve 60 engages a downwardly facing surface 49 provided on the valve cage 46 which is secured to the tubular body 10. Upward movement of tubular body 10 automatically moves the cones 30 and 30' therewith. Additionally, the bottom end 101*b* of the slot 101*a* provided in the upper rod portion 101 of the control mandrel 100 engages cross link 22 to move said link and the slip elements 20 and 20' therewith, thus maintaining a spacing between such slip elements and the cones 30 and 30' as the entire assemblage is moved upwardly to another position in the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well tool adaptable for movement longitudinally in a subterranean well conduit, comprising: a tubular body; first and second normally retracted slip means disposed around said body; first and second expander means responsive to movement of said body, said expander means being relatively movable into engagement with said first and second slip means, respectively, to selectively expand only one of said first and second slip means against the well conduit, one of said first and second slip means when in expanded position resisting downward movement of said well tool within said conduit and the other of said first and second slip means when in expanded position resisting upward movement of said well tool within said conduit; elastomeric packing means adjacent each said expander having a unidirectional sealing engagement with the conduit, whereby a downward fluid pressure differential on said elastomeric packing means shifts one of said expander means downwardly to expand said one slip means and an upward fluid pressure differential shifts the other said expander means upwardly to expand said other slip means; a mandrel operatively engageable with said tubular body to retract the tool from the well, said mandrel defining a bypass fluid passage extending around said other elastomeric packing means; and valve means in said byass fluid passage operable by longitudinal movement of said mandrel in either direction relative to said other expander means to open said bypass fluid passage, said valve means being opened by upward movement of said mandrel prior to effective disengaging movement of said slip and expander means.

2. The apparatus of claim 1 wherein said mandrel is positioned within said expander means and operatively engageable with said tubular body by a lost motion connection, said lost motion connection including an annular piston valve closing the upper end of the annulus between said tubular body and said mandrel, said mandrel having an upwardly facing surface movable upwardly into engagement with said annular piston valve, and said annular piston valve having an upwardly facing surface movable upwardly into engagement with a downwardly facing surface on said tubular body.

3. A well tool adapted to be moved longitudinally in a subterranean well conduit, comprising: a tubular body; mandrel means disposed within said body; a pair of axially spaced, normally retracted slip means carried by said mandrel for axial movement relative thereto; a pair of expanders respectively carried by said tubular body on opposite sides of said slip means; said expanders being concurrently axially movable relative to said slip means by said tubular body, whereby one or the other. of said slip means is expandable by relative axial movement of said tubular body and said slip means; a mandrel insertable through said tubular body; resilient means urging said mandrel to an inoperative position relative to said tubular body; a pair of elastomeric sealing means on said tubular body respectively responsive to upward or downward fluid pressure differentials to shift said tubular body and said expanders upwardly or downwardly relative to said slip means; fluid passage means in said mandrel and said tubular body extending around said one elastomeric sealing means responsive to upward fluid pressure differentials; valving means mounted on said mandrel and cooperating with said tubular body to close said fluid passage means in said inoperative position of said mandrel; said valving means being operable by either downward or upward movement of said mandrel from said inoperative position to an open flow position, thereby eliminating pressure differential across said one elastomeric sealing means to permit shifting of the tool, and means defining lost motion connections between said mandrel and said tubular body and between said mandrel and said slips, whereby said valving means is opened by upward movement of said mandrel prior to any upward movement of said tubular body or said slips.

4. The apparatus of claim 3 wherein said fluid passage means includes a first aperture in said tubular body disposed above said one elastomeric sealing means, a pair of axially spaced second apertures in said tubular body disposed below said one elastomeric sealing means; a radial port in said mandrel located between said second apertures in the inoperative position of said mandrel; an axially extending passage within said mandrel connecting said first aperture and said radial port; a pair of valve chambers respectively intermediate said second apertures and said radial port; and a pair of valve pistons respectively disposed in said valve chambers, said valve pistons being respectively movable downwardly and upwardly with said mandrel to establish pressure equalizing flow thru said axially extending mandrel passage.

5. A bridge plug for mounting in a subterranean well conduit comprising: a hollow elongated body having diametrically disposed slots; a cross link mounted, in said slots for axial movement relative to said hollow body; normally retracted slip elements mounted on the outer ends of said cross link; expander means secured to said hollow body and movable upwardly by said hollow body to engage and expand said slip elements into engagement with the wall of the well conduit; an annular elastomeric sealing element secured to said hollow body and movable upwardly in sealing engagement with the conduit wall by an upward fluid pressure differential, a mandrel insertable in said hollow body and axially movable relative to said hollow body and said cross link; means for resiliently positioning said mandrel in an inoperative position relative to said hollow body; means defining a lost motion connection between said mandrel and said tubular body, whereby substantial upward movement of said mandrel occurs before moving said tubular body upwardly; fluid passage means extending from a conduit region below said elastomeric sealing means to a conduit region above said elastomeric sealing means; valve means mounted on said mandrel for closing said fluid passage means in said inoperative position of said mandrel, said valve means being operable by axial displacement of said mandrel relative to said hollow body in either direction to open said fluid passage means and equalize the fluid pressure across said elastomeric sealing means, said valve means being opened by upward movement of said mandrel prior to any upward movement of said tubular body and said slips to effectively disengage said slip and expander elements.

6. The apparatus of claim 3, 4 or 5 wherein said lost motion connection means includes an annular piston valve closing the upper end of the annulus between said tubular body and said mandrel, said mandrel having an upwardly facing surface movable upwardly into engagement with a downwardly facing surface on said tubular body.

7. In a bridge plug for a subterranean well conduit having a tubular body, expandable slip means carried by a cross link disposed in an axially extending slot in said hollow body, expander means carried by said tubular body below said expandable slip means, and elastomeric seal means secured to said hollow body and having unidirectional sealing engagement with the conduit by an upwardly directed fluid pressure differential, the improvement comprising: a mandrel insertable in said tubular body and axially movable relative thereto; resilient means positioning said mandrel in an inoperative position relative to said tubular body; an axial fluid passage in said mandrel extending from a region below said elastomeric sealing means to a region above said elastomeric sealing means; an external flange on said mandrel positioned intermediate the length of said fluid passage; a radial fluid passage through said internal flange communicating with said axial fluid passage; an internal flange on said tubular body adjacent said external mandrel flange; annular seal bores defined between said tubular body and said mandrel adjacent each axial end of said mandrel flange; a pair of annular valve pistons sealingly mounted in said annular seal bores; and fluid passage slots in said tubular body above and below said valving pistons, whereby either downward or upward movement of said mandrel from said inoperative position relative to said tubular body selectively connects one of said fluid passage slots to said mandrel fluid passage to equalize fluid pressure above and below said elastomeric sealing means.

8. The apparatus for claim 7 wherein said resilient means comprise a pair of compression springs respectively mounted between said tubular body and said valving pistons to hold said valving pistons against said mandrel external flange.

9. The apparatus of claim 7 further comprising a lost motion connection between said mandrel, said tubular body and said slips in an upward direction, said lost motion exceeding the upward motion of said mandrel required to connect the upper one of said fluid passage slots to said mandrel fluid passage.

10. The apparatus of claim 9 wherein said lost motion connection includes an annular piston valve closing the upper end of the annulus between said tubular body and said mandrel, said mandrel having an upwardly facing surface movable upwardly into engagement with said annular piston valve, and said annular piston valve having an upwardly facing surface movable upwardly into engagement with a downwardly facing surface on said tubular body.

11. In a bridge plug for a subterranean well conduit having a hollow body, expandable slip means disposed in an axially extending slot in said hollow body; expander means carried by said tubular body below said expandable slip means, and elastomeric seal means sealingly extending from said hollow body and having unidirectional sealingly engagement with the conduit by an upwardly directed fluid pressure differential, the improvement comprising: a mandrel insertable in said tubular body and axially movable relative thereto; a pair of axially spaced fluid passage slots in said tubular body below said elastomeric sealing means; an external-flange on said mandrel disposed between said fluid passage slots in an inoperative position of said mandrel; an axial fluid passage in said mandrel extending from said external flange to a region above said elastomeric sealing means; a radial passage through said mandrel external flange connecting with said axial fluid passage; and a pair of annular valve elements respectively disposed on the upper and lower sides of said external flange to prevent fluid flow from said fluid passage slots into said mandrel radial passage, whereby downward or upward movement of said mandrel from said inoperative position relative to said tubular body respectively shifts one of said annular valve elements to produce pressure equalizing fluid flow through said mandrel fluid passages.

12. The apparatus of claim 11 further comprising a pair of compression springs respectively mounted between said tubular body and said annular valve elements to urge said valving elements against said mandrel external flange and position said mandrel in said inoperative position relative to said tubular body.

13. The apparatus of claim 12 further comprising a lost motion connection between said mandrel, said tubular body and said slips in an upward direction, said lost motion exceeding the upward motion of said mandrel required to connect the upper one of said fluid passage slots to said mandrel fluid passage.

14. The apparatus of claim 13 wherein said lost motion connection includes an annular piston valve closing the upper end of the annulus between said tubular body and said mandrel, said mandrel having an upwardly facing surface movable upwardly into engagement with said annular piston valve, and said annular piston valve having an upwardly facing surface movable upwardly into engagement with a downwardly facing surface on said tubular body.

* * * * *